US005829487A

United States Patent [19]

Thomas et al.

[11] Patent Number: 5,829,487

[45] Date of Patent: Nov. 3, 1998

[54] METHOD FOR REPRESENTING A FABRIC CONSISTING OF WARP AND WEFT THREADS

[75] Inventors: Wolfgang Thomas; Klaus-Peter Lepka, both of Krefeld, Germany

[73] Assignee: EAT Elektronische Ateliertechnik Textil GmbH, Kempen, Germany

[21] Appl. No.: 887,757

[22] Filed: Jul. 3, 1997

Related U.S. Application Data

[63] Continuation of Ser. No. 501,184, Jul. 11, 1995, abandoned.

[30] Foreign Application Priority Data

Jul. 12, 1994 [EP] European Pat. Off. ..... 94110818

[51] Int. Cl.[6] ..... D03D 19/00

[52] U.S. Cl. ..... 139/319; 382/111; 345/430; 364/470.11; 364/470.02

[58] Field of Search ..... 364/526, 470, 364/470.02, 470.11; 139/319, 1 R; 382/111; 66/231, 232; 345/430

[56] References Cited

U.S. PATENT DOCUMENTS

| | | | |
|---|---|---|---|
| 3,744,035 | 7/1973 | Geirhos et al. | 139/319 |
| 4,078,253 | 3/1978 | Kajiura et al. | 364/470 |
| 4,954,976 | 9/1990 | Noonan | 364/578 |
| 5,016,183 | 5/1991 | Shyong | 364/470 |
| 5,058,174 | 10/1991 | Carroll | 139/319 |
| 5,136,519 | 8/1992 | Yonemitzu | 364/470 |
| 5,200,904 | 4/1993 | Tottman | 364/470 |
| 5,307,283 | 4/1994 | Sawazaki et al. | 364/470 |
| 5,331,564 | 7/1994 | Barea | 364/470 |

FOREIGN PATENT DOCUMENTS

| | | | |
|---|---|---|---|
| 0302576 | 2/1989 | European Pat. Off. | 139/319 |
| 004235487 | 4/1994 | Germany | 139/319 |

*Primary Examiner*—Andy Falik

*Attorney, Agent, or Firm*—John F. A. Earley; John F. A. Earley, III; Harding, Earley, Follmer & Frailey

[57] ABSTRACT

A method for representing optically a fabric consisting of warp and weft threads and with a pattern. To optically represent the fabric, the pattern is acquired by scanning from a model, or from an existing data carrier, or represented directly on a computer display. A crossing scheme is then assigned to the warp and weft threads. The course of the warp and weft threads is then determined by varying at least one of any parameters specific for the thread, such as the number of color components of a single thread and their distribution, the construction of the thread's surface or the material of the thread and by varying at least one of any parameter specific for the fabric, such as the closeness of the warp and weft threads, the advance of material in weaving, the sequence of the warp threads or the control functions for a weaving machine. Thereafter, the previously determined course of the warp and weft threads is corrected by varying at least one of any dynamic behavior or course of the warp and weft threads, such as the floating behavior of the threads, the underweave of individual threads or the course in crossing points of different weaves. The corrected course of the warp and weft threads is then represented optically on an output unit such as a display or by an output unit such as a printer.

6 Claims, 1 Drawing Sheet

METHOD FOR REPRESENTING A FABRIC CONSISTING OF WARP AND WEFT THREADS

This is a continuation of application Ser. No. 08/501,184 filed on Jul. 11, 1995 abandoned.

FIELD OF THE INVENTION

The invention relates to a method for representing optically a fabric consisting of warp and weft threads and with a pattern.

SUMMARY OF THE INVENTION

The object of the invention is to provide such a method which can represent optically the fabric including its pattern, without weaving of the fabric being necessary. Preferably different types of fabric, which may also be combined in a single fabric, should be representable.

In order to achieve the object, the invention suggests two embodiments being subject to the same principle. One of the embodiments takes into account that the pattern for the fabric to be represented can be illustrated in a graphical model or input into a computer, respectively. In the other embodiment it is presumed that already a data carrier containing information about a fabric exists.

In the first embodiment the patterns are acquired by a computer and, if desired, represented, for example by a display. The patterns may be scanned from a model or represented directly on a display. Then a crossing scheme is assigned to the warp and weft threads forming the fabric, the weaves of which the fabric is to consist being determined.

In the second embodiment it is presumed that the pattern exists already—for example memorized in a punched card. There, data on the crossing scheme of the warp and weft threads may exist as well. In this embodiment the missing informations are added in dependence on already existing informations. The pattern and possibly the crossing scheme may be memorized on any storage medium.

The following steps of the method according to claims 1 and 2 are similar for both embodiments. Therefore, for both embodiments of the method they are described together.

The pattern and the crossing scheme are acquired in a computer. Taking into account the parameters specific for the thread and the fabric parameters, the course of the warp and weft threads are then determined.

This course of the warp and weft threads is corrected, taking into account the dynamic behavior and course of the threads, and then the corrected course of the warp and weft threads forming the fabric to be represented is optically represented.

DESCRIPTION OF THE PRIOR ART

A method for simulating a dyed fabric is known from the EP 0 302 576 B1. In this simulation the colors of the fabric, which are represented on an output unit, are to be compared to colors being spectrophotometrically measured and to be corrected so that the simulated and the real colors correspond. With this known method only the colors are considered. With this method important factors, for example the dynamic behavior and course of the warp and weft threads and parameters specific for the thread and fabric parameters as well, are completely left out of the consideration. The appearance of a really woven fabric is greatly influenced particularly by this factors. The simulated fabrics are to represent the fabric as accurately as possible. Because of ignoring these factors determining decisively the appearance of a fabric, the simulated fabric shows deviations from a real fabric, so that it is difficult to judge, whether a simulated fabric should be woven or not.

But with the method according to the invention these important factors are particularly taken into account so that a fabric can be represented optically in accordance with reality. From this optical representation can be decided, whether the fabric is to be woven or not. Therefore, with this method the production of real fabrics which represent the real appearance is no longer necessary. Thereby costs are cut down because no additional fabrics have to be produced.

DESCRIPTION OF THE DRAWINGS

With the method according to the invention the two crossing schemes or weaves of the warp and weft threads are respectively shown in FIGS. 1 & 2.

DESCRIPTION OF THE PREFERRED EMBODIMENT

Figure 1:
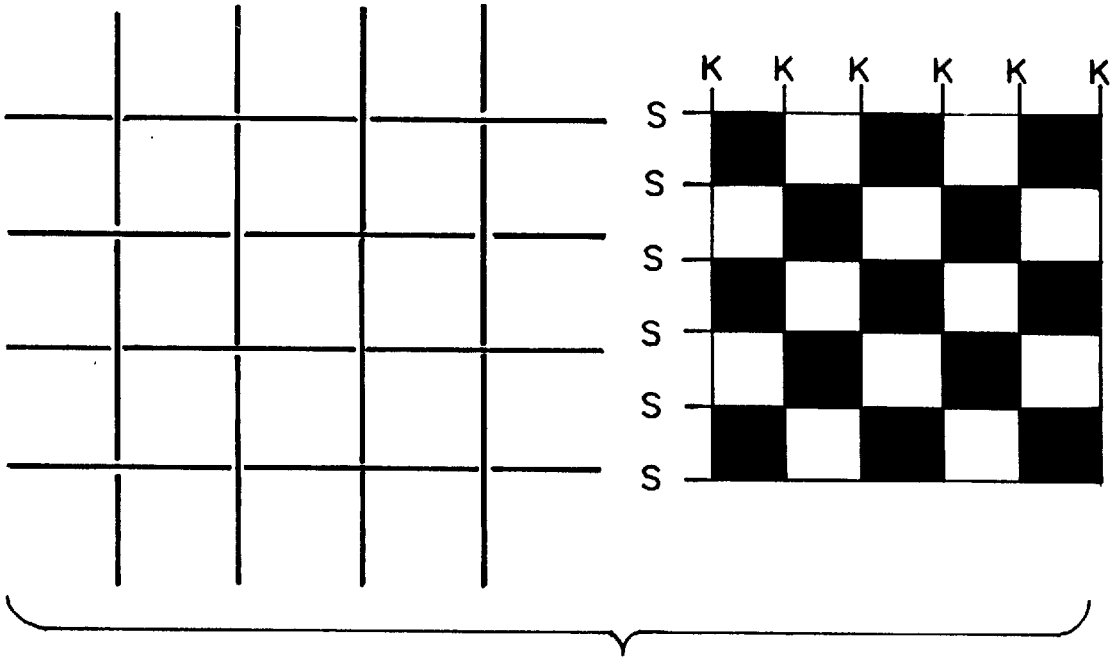
Figure 2:
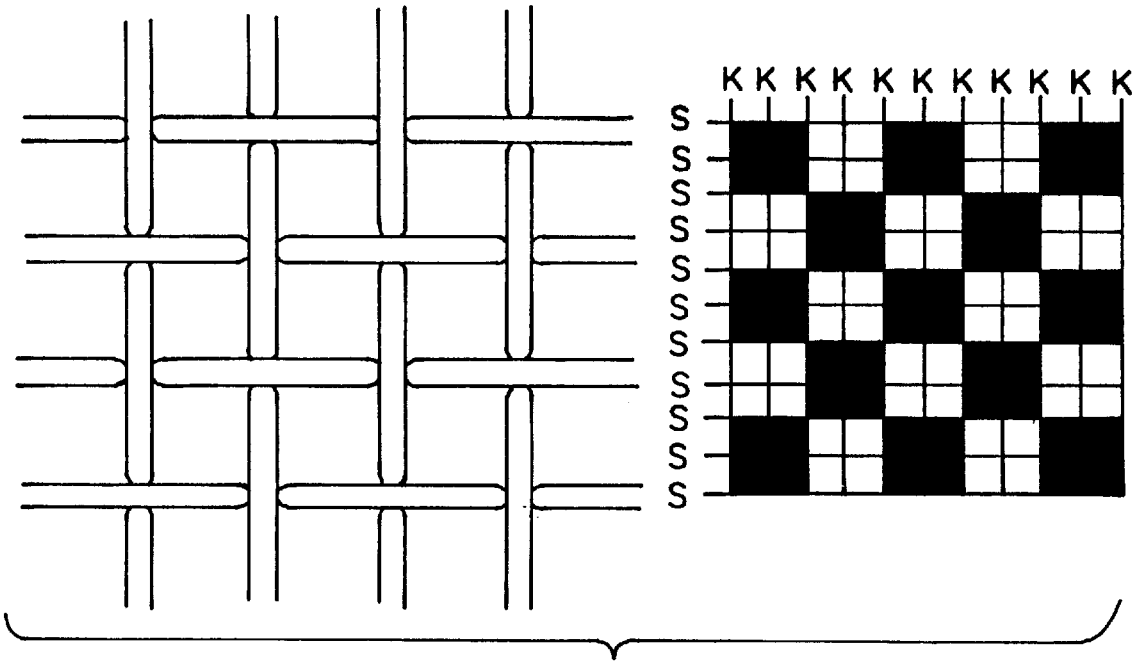

In both of the figures two different weaves of fabric are illustrated. FIG. 1 shows a linen weave, as it is called, in which one warp thread and one weft thread cross at a time, the warp threads running vertically and the weft threads running horizontally. Additionally, the linen weave is illustrated in dual representation, in this case in form of a weave design, as it is called. There, the space between every two vertical lines K illustrates a warp thread, and the space between every two horizontal lines S illustrates a weft thread. Here, in order to mark the crossing points, the relevant square is set off by black marking, that is the crossing of the warp and weft threads, at all places where the warp threads overlie the weft threads (upper runnings of the warp). Accordingly, the white squares indicate weft threads lying on top (lower runnings of the warp). In FIG. 2, there is analogously illustrated a hopsack weave, as it is called, which is formed by two crossing warp and weft threads at a time, together with the appertaining weave design. With the method according to the invention the crossing scheme, for example in dual representation in form a of the weave design, determines the fabric.

After acquisition of the crossing scheme the crossing points of the warp and weft threads can be determined by their respective space coordinates. Using a Cartesian system of coordinates (x,y,z), for example, in which the orientation of the z-axis describes the depth, a crossing point of a warp thread and a weft thread is determined by an x- and a y-value and by two z-values, a z-value of the warp thread and a z-value of the weft thread. Additionally, the diameter of the threads can be taken into account, which affects the respective z-coordinates.

In determining the course of the warp and weft threads the parameters specific for the thread may include the number of color components of a single thread and their distribution, the structure of the thread surface and/or the material of the thread.

The number and the distribution of the colours, of which a single thread consists, affects the appearance of a fabric.

The thread surface has also a decisive influence on the appearance because, for example, a fleecy thread appears differently in a fabric from a thread with a smooth surface. Additionally, the effect of a fancy yarn can be taken into account.

The material of a thread determines considerably the behaviour of a thread in a fabric. A loosely spun thread covers very much more another thread located under that thread than a thread which is spun very firmly.

The course of the warp and weft threads is also determined by the fabric parameters. The closeness of the warp and weft threads may be included in them. Also, the advance of material in weaving, that is the speed with which the fabric is drawn off, may affect the closeness of the fabric and with it the mutual pushing together of the treads, which changes the appearance of the fabric. The faster the material advances the more loosely is the holding together of the threads and the smaller is the variation in the shape of different yarn portions.

In the fabric parameters the sequence of the warp threads in weaving may also be taken into account. In addition, the control functions for a weaving machine may be indicated.

The appearance of a fabric may also be influenced by the floating behavior of the threads, the underweave of some threads, the course of the thread at crossing points and by different weave types.

By floating behavior one understands that a weft thread is led on the upper surface over several adjacent warp threads. A weft thread, which is not led alternately over and under adjacent warp threads, as with the linen weave (FIG. 1), but is led over several adjacent warp threads, widens very much more on the surface. In contrast, with the underweave the weft thread runs across several warp threads on the lower surface.

The influence of different weave types can be seen clearly from FIGS. 1 and 2. With the hopsack weave (FIG. 2) the two weft threads are pushed together when running underneath a warp thread, while they "expand" when running over a weft thread. This applies analogously to weft threads running underneath warp threads. With the linen weave (FIG. 1) the individual weft thread underneath a warp thread is also somewhat compressed, and vice versa. Regarding this, the influence on the appearance of the fabric is very much smaller than with the hopsack weave. Different weave types occuring together in one fabric also influence the appearance of the fabric. The features of the method, which are described above, include acquiring and/or representing the pattern of a fabric with the aid of a computer, assigning a crossing scheme to the warp and weft threads of a fabric, determining the course of the warp and weft threads taking into account the parameters specific for the thread and the fabric parameters, correcting the previously determined course of the warp and weft threads taking into account the dynamic behavior and course of the warp and weft threads, and representing optically the corrected course of the warp and weft threads. The parameters specific for the thread comprise at least the number of color components of a single thread and their distribution, the structure of the thread surface, and/or the material of the thread. The fabric parameters comprise the closeness of the warp and weft threads, the advance of material in weaving, the sequence of the warp threads, and/or the control functions of a weaving machine. The correction of a course of the warp and weft threads comprises the floating behavior of the threads, the underweave of individual threads, the course in crossing points, and/or different weaves. The corrected course of the warp and weft threads is represented on or by an output unit. The pattern is scanned from a model or represented directly on a display.

The thus corrected course of the warp and weft threads, which describes a realistic illustration of a fabric, can be made optically visible on an output unit such as a display or by an output unit such as a printer.

Also, colors may be assigned to the individual warp and weft threads of the fabric. There, it is advantageous to assign the colors of the thread after correction of the course, because then the colors can be adapted, corresponding to the said correction factors, to the actual optical impression of the real fabric without having to determine the fabric again, so that time and, consequently, costs can be reduced. By using colors the correct representation of the fabric is checked as well.

Good results, that is the colors of the represented fabric correspond to the colors of the real fabric, can be achieved, if the colors are selected in dependence on the colors representable by the output unit. With this, it is ensured that the representation of the colors corresponds to the input chromaticities.

The chromaticities which, for example, are given in RYB-coordinates, may be taken from a color atlas, where the coordinates are indicated.

It is not necessary that the colors are measured spectrophotometrically with a real thread, as with the method known from the EP 0 302 576 B1. The advantage of this is that there need not be a dyed thread beforehand, with which the colors are measured. Therefore, only those threads have to be dyed, which are required for the fabric.

Furthermore it is possible to take into account shadow effects caused by threads lying upon another, and different illumination effects as well.

Further characteristics of the invention can be seen from the features of the subclaims and the other application documents.

We claim:

1. An improved method for representing optically a fabric having a pattern and specific parameters, said fabric having warp and weft threads having parameters specific for the threads, a dynamic behavior, a course, space coordinates at crossing points, and chromaticites, of the type wherein the pattern is acquired by scanning from a model, or by scanning from an existing data carrier, or by representing it directly on a computer display, the improvement comprising assigning a crossing scheme to the warp and weft threads, determining the course of the warp and weft threads by varying at least one of any parameters specific for the threads, such as the number of color components of a single thread and their distribution, the structure of the thread surface or the material of the thread, and by varying at least one of any parameters specific for the fabric, such as the closeness of the warp and weft threads, the advance of material in weaving, the sequence of the warp threads or the control functions for a weaving machine, correcting thereafter the previously determined course of the warp and weft threads by varying at least one of any said dynamic behavior or course of the warp and weft threads, such as the floating behavior of the threads, an underweave of individual threads or the course of the thread(s) at crossing points or different weaves, and representing the corrected course of the warp and weft threads optically on an output unit such as a display or by an output unit such as a printer.

2. Method according to claim 1, further including the step of assigning different colors to the individual threads after correction of the course of the warp and weft threads.

3. Method according to claim 2, further including the step of selecting the colors in dependence on the colors representable by the output unit.

4. Method according to claim 2, further including the step of taking the chromaticities from a color atlas.

5. Method according to claim 1, further including the step of representing the crossing scheme of the warp and weft threads by a dual representation, such as a weave design.

6. Method according to claim 1, after determining the crossing scheme, further including the step of determining the crossing points of the warp and weft threads by their respective space coordinates and the diameter of the threads.

* * * * *